United States Patent [19]

Moore

[11] 4,058,094

[45] Nov. 15, 1977

[54] SPEED CONTROL DEVICE

[76] Inventor: Franklin Eldridge Moore, 327 W. 6th St., Long Beach, Calif. 90802

[21] Appl. No.: 591,779

[22] Filed: June 30, 1975

[51] Int. Cl.[2] ..... F02D 11/10

[52] U.S. Cl. ..... 123/102; 180/105 E; 318/318; 318/328; 361/236

[58] Field of Search ..... 123/102; 180/105 E; 318/318, 328, 329; 317/5

[56] References Cited

U.S. PATENT DOCUMENTS

| | | | |
|---|---|---|---|
| 2,395,516 | 2/1946 | Morton | 318/318 |
| 2,395,517 | 2/1946 | Stoller | 318/318 |
| 2,790,126 | 4/1957 | Fairweather | 318/328 |
| 3,042,836 | 7/1962 | Hamilton et al. | 317/5 |
| 3,084,307 | 4/1963 | Landis | 318/328 |
| 3,249,098 | 5/1966 | Rosenberg | 123/102 |
| 3,335,349 | 8/1967 | Cooper | 318/318 |
| 3,402,327 | 9/1968 | Blackburn | 123/102 |
| 3,525,017 | 8/1970 | Rosenberg et al. | 317/5 |
| 3,944,901 | 3/1976 | Janssen et al. | 318/318 |

*Primary Examiner*—Ronald B. Cox

[57] ABSTRACT

A regulating servo loop for controlling the speed of an internal combustion engine to a preselected rate, including a tachometer connected for rotation of the output of the engine, a mechanical actuator controlling the carburetor opening of the engine and a resonating error circuit for detecting the error between the preselected rate and the tachometer output. The mechanical actuator includes a D.C. servo motor which is driven in the correcting direction by a transistor circuit according to the phase lag of the resonating circuit.

3 Claims, 3 Drawing Figures

SPEED CONTROL DEVICE

BACKGROUND OF THE INVENTION

1. Field of the Invention

The present invention relates to servo control systems and more particularly to electronic governors controlling the rate of rotary power plants.

2. Description of the Prior Art

Control devices for regulating the speed of various power plants have been known in the past. In particular, regulation of internal combustion engines used with small electric power generators is often critical both in frequency and in the total power output. For this reason power plants designed for such unattended use have been provided with various speed regulators, typically in the form of regulating servos. A servo-loop adapted for such regulation most often centers around a tachometer pick-off, where the output of the tachometer is normally converted to a D.C. voltage compared at a summing amplified with a reference voltage to produce an error signal correcting the engine speed. A typical tachometer however is generally configured as an A.C. device. Thus, the output of the tachometer is normally cyclic and is converted from such cyclic form to a D.C. signal for comparison.

Alternatively, servo systems generally referred to as A.C. servos, avoid this rectification of the tachometer output by providing a servo loop which operates on the basis of A.C. signals. Systems of this kind however, all include either phase detection or complex amplification and therefore are not much simpler in their structure from the most basic D.C. servos.

SUMMARY OF THE INVENTION

Accordingly, it is the general purpose and object of the present invention to provide a speed control system adapted for use with unattended power plants, which directly takes benefit of the phase reversal around resonance of a resonant circuit in order to develop the corrective signals.

Other objects of the invention are to provide a speed control servo which compares the output of a tachometer attached to a rotary power plant against a preset resonance in a tuned circuit.

Further objects of the invention are to provide control through a D.C. servo motor directly from the output of a tuned circuit.

Briefly, these and other objects are accomplished in the present invention by providing a tachometer connected for rotation to the output shaft of the power plant to be controlled where the output of the tachometer is connected, across an isolation transformer, to the equivalent of a tuned notch filter selectively set to any desired center frequency. The output of the filter is then rectified to control both the power and the phase of a complementary preamplifier stage which in turn controls the conduction through a power amplifier to apply excitation in either forward or reverse direction across the winding of a servo motor. The servo motor then controls the air-fuel mixture to the engine to appropriately correct the speed of the power plant to the preselected frequency of the notch filter.

In this manner the benefits of the notch filter are utilized in a particularly novel way to provide an increment of linear control about zero loop error, thus avoiding the common problem of zero dead band in on-off systems.

DESCRIPTION OF THE SPECIFIC EMBODIMENT

While the following description discloses a control system in association with an internal combustion engine, such is for the purposes of description only. It is to be noted that uses other than the control of the speed of an internal combustion engine are contemplated and no intent to limit the scope of the present invention by this selection of examples is is expressed hereby.

Figure 1:
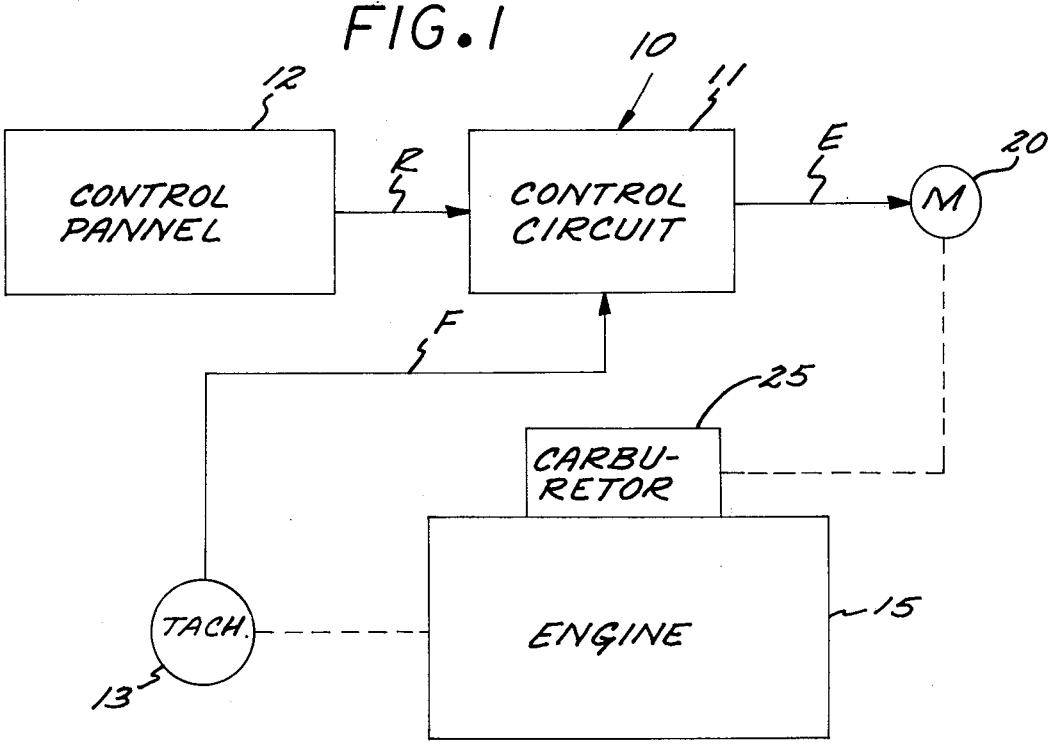
FIG. 1 is a diagrammatic illustration of the inventive speed control system functioning in association with an internal combustion engine.

As shown in FIG. 1 the inventive control system designated generally by the numeral 10 includes a control circuit 11 receiving a reference input R from a control panel 12 and a feed back signal F from a tachometer 13 which in turn is connected for rotation to the output shaft of an engine 15. The control circuit 11, by means to be further described below, generates an error signal E to a servo motor 20 which in turn controls a mechanical linkage attached to articulate the opening of a carburetor 25 mounted on engine 15.

Figure 2:
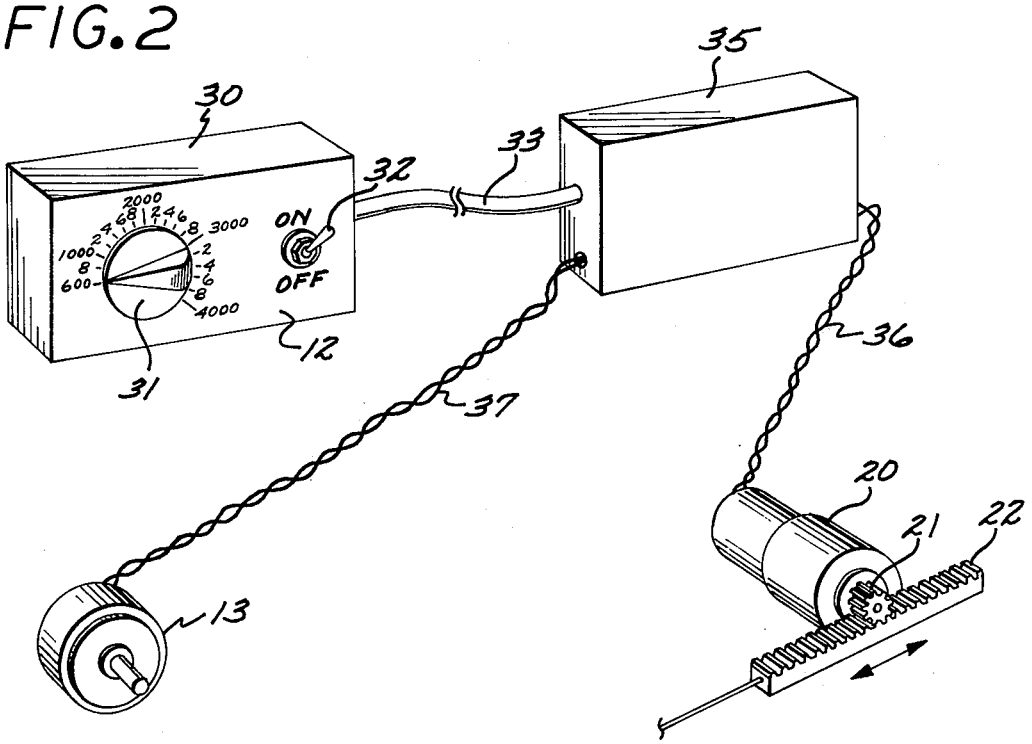
FIG. 2 is an illustration, in perspective, of the various mechanical components of the inventive speed control system.

While there are many ways of arranging the general blocks described above in physical implementation, one selected way is shown in FIG. 2. In particular, FIG. 2 illustrates the control panel 12 on the face of a control enclosure 30, having mounted therein a potentiometer 31 by which various levels of signal R are selected. Also included on the control panel 12 is a main power switch shown as an on-off switch 32. Both the power and the signal R are connected by way of a harness 33 to an enclosure 35 housing the control circuit 11. Enclosure 35 connects by a dual strand harness 36 to the servo motor 20, thus improving signal E thereto. Servo motor 20 is a DC motor such as the Barber Coleman FYQM-33410-3 reversible motor terminating in a pinion 21 on the output thereof. Pinion 21 in turn engages a rack 22 which articulates the opening in carburetor 25. At the same time, enclosure 35 receives the feedback signal F across yet another dual strand harness 37 from the tachometer 13. Tachometer 13 is similarly a Barber Coleman CYOM tachometer, having sicteen poles and a single station pick up coil. The connection of the tachometer to the output shaft of engine 15 is conventional and is therefore not shown. It being intended that any conventional engagement of tachometer 13 with the output shaft of the engine be adequate for the purposes herein.

Figure 3:
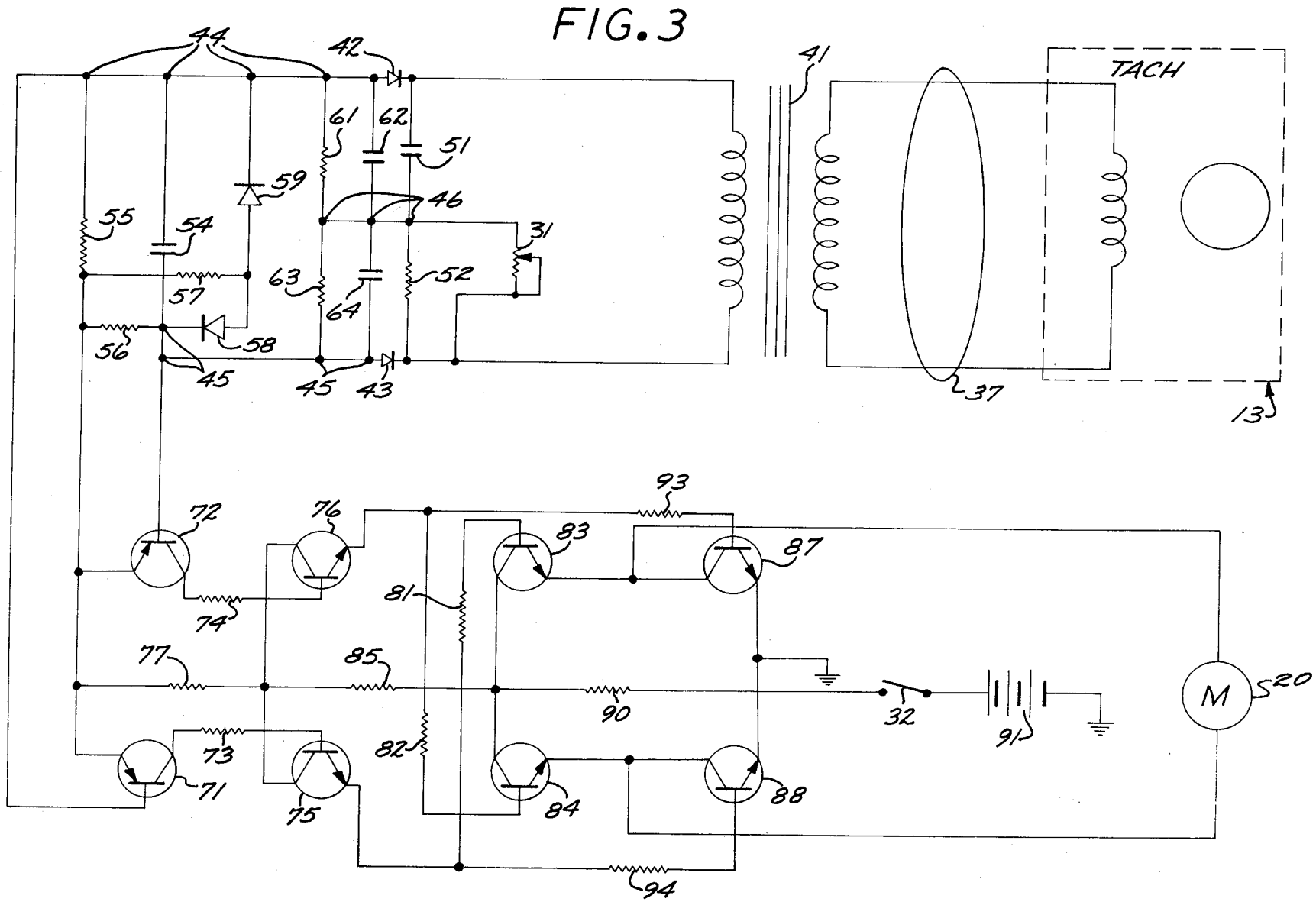
FIG. 3 is a circuit diagram of the electrical circuit adapted for use with the present invention.

As shown in FIG. 3, the pickup of tachometer 13 is connected by way of the dual strand harness 37 to the primary of a transformer 41, impressing the cyclic tachometer output signals thereof. The secondary of transformer 4 is respectively connected between the cathodes of diodes 42 and 43 which, at their anodes, tie to corresponding circuit junctions 44 and 45. The secondary of transformer 41 is furthermore connected in parallel across an RC circuit including a capacitor 51 and a resistor 52 in series, which, at their common connection form a third circuit junction 46.

Tied across circuit junctions 44 and 45, and therefore between the anodes of diodes 42 and 43, respectively, is a capacitor 54 in parallel with a resistive voltage divider formed by an upper resistor 55 and a lower resistor 56. The division point between resistors 55 and 56 is brought out to a battery power supply to be further described and across resistor 57 and to the anodes of two diodes, respectively, shown as diodes 58 and 59. Diodes 58 and 59 at their cathodes connect to the corresponding junctions 44 and 45.

In addition, junction 44 is tied to junction 46 by an RC circuit comprising a resistor 61 in parallel with a capacitor 62. Similarly, junction 45 ties to junction 46 by way of a resistor 63 in parallel with a capacitor 64. In this manner a resonant circuit is formed around the secondary of transformer 41 which discriminates by way of signal polarity at junctions 44 and 45 whether the tachometer is operating at a speed above or below a preselected resonance.

The selection of resonance of this circuit is provided by way of the potentiometer 31 shown connected across resistor 52. Thus, if the frequency so selected is exactly matched by the output of the tachometer, the reactance of capacitor 51 and the combined resistance of resistor 52 and potentiometer 31 are equal. If the engine speed falls below this point of equilibrium the reactance of capacitor 51 increases, driving the junction 44 more negative with respect to junction 45. Similarly, if the speed is above the preset speed, junction 45 is more negative with respect to junction 44.

In this manner a circuit operating analogously to a notch filter is provided which further more discriminates polarity by way of the rectifying diodes 42 and 43.

This frequency discrimination is now brought out by a preamplifier stage having the emitters of two PNP transistors 71 and 72 connected to a power supply or the division point between resistors 55 and 56, transistors 71 and 72 being respectively controlled at their bases by the respective signals on junctions 44 and 45. The collectors or transistors 71 and 72 in turn connect a corresponding pair of base resistors 73 and 74 to drive the bases of two NPN transistors 75 and 76 respectively.

The collectors of transistors 75 and 76 are tied across a resistor back to the division point between resistors 55 and 56. Transistors 71, 72, 75 and 76 thus form a complementary preamplifier stage which raises the signals developed at junctions 44 and 45 to working levels. This raised signal is then applied to selected control points of a differentially connected output stage connected across the winding of the servo motor.

More specifically the emitter of transistor 75 controls across a base resistor 81, a power transistor 83. Similarly transistor 76 controls across a base resistor 82, a power transistor 84. Transistors 83 and 84 connect at the collector thereof in common across a collector resistor 90 to the main power switch 32 which in turn completes the circuit from a battery 91. This same power input is connected across a collector resistor 85 to the collectors of transistors 75 and 76. Transistors 83 and 84 then respectively connect by their emitters to the two terminals of the servo motor 20. Thus, when transistor 83 is conducting circuit continuity between battery 91 and one side of the motor is provided.

To complete the circuit to ground yet another transistor pair is controlled in complement with transistors 83 and 84 specifically comprising power transistors 87 and 88, the conduction of transistor 87 being controlled by the emitter of transistor 76 across a base resistor 93 while the conduction of transistor 88 is controlled from the emitter of transistor 75 across a base resistor 94. Transistors 87 and 88 are configured in a common emitter circuit, connecting at the collectors thereof to the respective emitters of transistors 83 and 84. In this manner when transistor 83 is conducting transistor 87 which is connected to the same side of the motor is not conducting. Similarly, when the transistor 84 is conducting transistor 88 will be nonconductive. Accordingly, when transistor 83 is conducting, transistor 88 is also conducting providing circuit continuity between battery 91 and ground to control the motor 20 in a particular direction. The reverse direction is accomplished by rendering transistors 84 and 87 conductive.

By way of this arrangement, total field reversal can be achieved by way of simple transistor control which is dependent on the phase lag of the resonant circuit. Since the resonant circuit is a Q circuit a phase change from 0° to 180° will occur within few cycles around resonance. This resonance can be selectively adjusted to any speed desired, allowing for direct control over motor response. In addition, since the phase change from 0° to 180° of a resonant circuit is normally always continuous, this manner of achieving control avoids discrete switchover by providing some non-linear continuous control at about 90° phase. Thus, by way of this inventive arrangement, the problems typically associated with on-off control which normally calls for the introduction of a deadband are conveniently avoided. In addition the inventive circuit provides for control which is easily adjustable, is essentially self balancing and therefore requires minimum maintenance.

Obviously many modifications and variations to the above disclosure can be made without departing from the spirit of the invention. It is therefore intended that the scope of the invention be determined solely dependent on the claims hereto.

I claim:

1. A speed governing device adopted to control the rate of a rotating power plant comprising:

control means connected to said power plant for controlling the rotational rate thereof;

a rate sensor connected to the output of said power plant for providing a cyclic feedback signal proportional to the rotational rate of said power plant;

a resonant circuit connected to receive said cyclic feedback signal for producing an output signal of a first polarity when said cyclic signal is above a predetermined frequency and of a second polarity when said cyclic signal below said predetermined frequency;

first amplifying means connected to receive said output signal from said resonant circuit including first biasing means, said first amplifying means in combination with said biasing being rendered responsive to said first polarity of said output signal for producing a first control signal indicative thereof;

second amplifying means connected to receive said output signal from said resonant circuit including second biasing means, said second amplifying and biasing means being operative in combination to be rendered responsive to said second polarity of said output signal for producing a second control signal indicative thereof; and a servo motor connected to receive said first and second control signals for producing control inputs to said control means according to the presence of said first or second control signal, said first and second amplifying means each include a PNP first transistor forming a first preamplifier stage and an NPN transistor forming a second preamplifier stage in circuit with said first preamplifier stage.

2. Apparatus according to claim 1 wherein:

said resonant circuit includes rectifying means for selectively impressing said output signal to said first or second amplifying means.

3. Apparatus according to claim 2 wherein:

said resonant circuit further includes a transformer connected to receive said cyclic feedback signal at the primary thereof a capacitor in series with a resistor connected across the secondary of said transformer and a manually adjustable potentiometer connected across said resistor for selecting said predetermined frequency.

* * * * *